US006145794A

United States Patent [19]

Smith

[11] Patent Number: 6,145,794

[45] Date of Patent: Nov. 14, 2000

[54] SUPPORT PLATFORM FOR MOBILE DISPLAY STAND

[75] Inventor: Michael J. Smith, Orangeburg, N.Y.

[73] Assignee: Arrow Art Finishers, L.L.C., Princeton, N.J.

[21] Appl. No.: 09/226,444

[22] Filed: Jan. 6, 1999

[51] Int. Cl.[7] ..... F16L 3/00

[52] U.S. Cl. ..... 248/121; 248/459; 211/149; 211/132.1

[58] Field of Search ..... 248/121, 174, 248/152, 459; 211/149, 132.1

[56] References Cited

U.S. PATENT DOCUMENTS 3,856,320 12/1974 Blanchard ..... 280/47.35
3,987,737 10/1976 Smith ..... 211/149 X
4,632,412 12/1986 Nasgowitz ..... 280/47.26
5,628,523 5/1997 Smith ..... 280/47.26
5,660,404 8/1997 Dilley ..... 211/149 X
5,711,438 1/1998 Smith ..... 248/174

*Primary Examiner*—Ramon O. Ramirez
*Assistant Examiner*—A. Joseph Wujciak
*Attorney, Agent, or Firm*—Kirschstein, et al.

[57] ABSTRACT

A mobile support platform is mounted as a unit on, and is removed as a unit from, a display stand for supporting articles. The platform includes a generally planar, support panel sandwiched between a pair of generally planar, base panels of the stand. A pair of side lifts on the support panel elevates the base panels above a floor to enable access to a power-operated prong of a forklift. A pair of side wheel assemblies on the support panel enable the stand to be manually pushed and rolled from place to place.

19 Claims, 4 Drawing Sheets

10
12
14
16
18
20
22
24
26
28
30
32
34
36
38
40
42
44
46
48
50
52
54
56
58
60
62
64
64'
70
72
74
76
78
80
82
84
86
88
90
92
106
108
110
112

FIG. 6
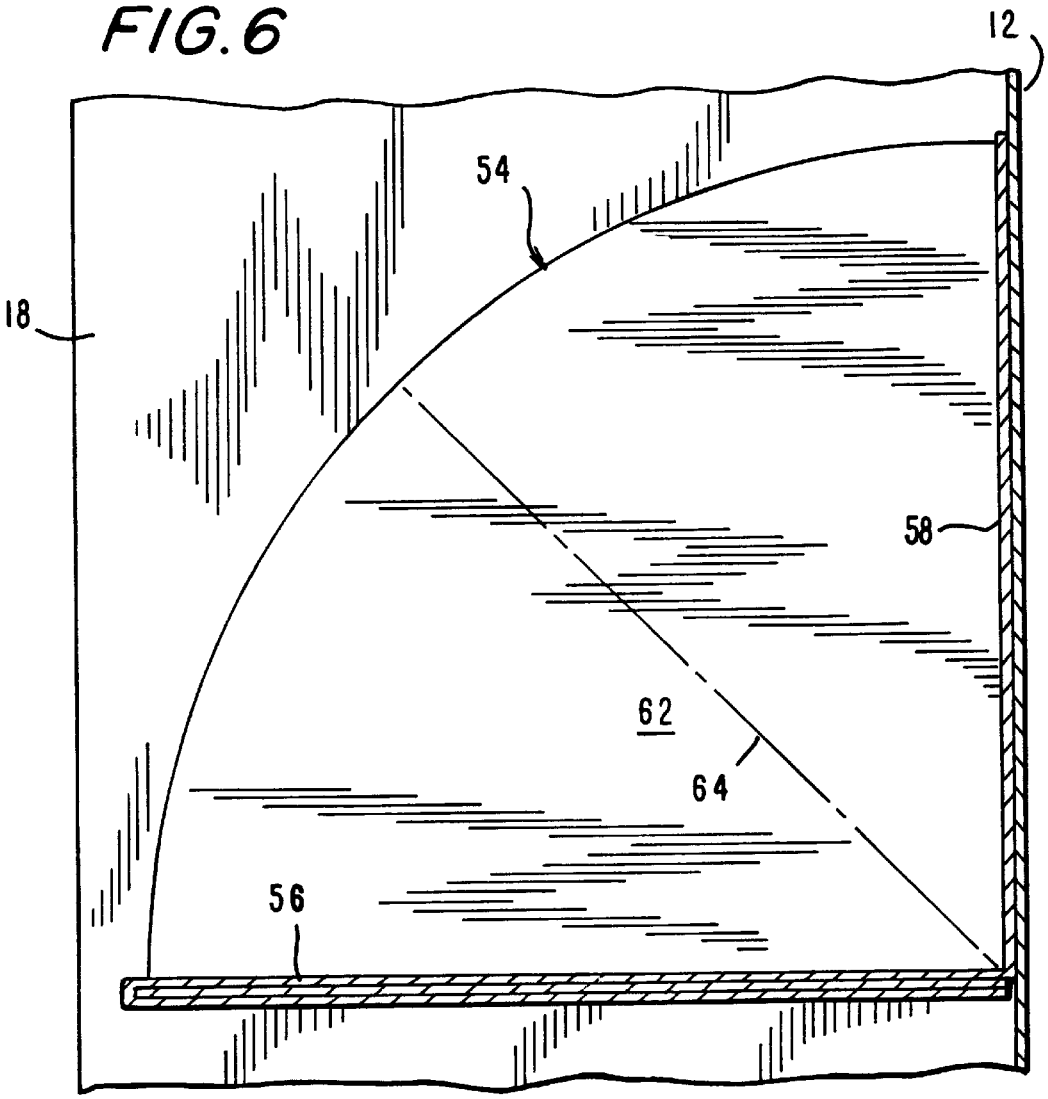
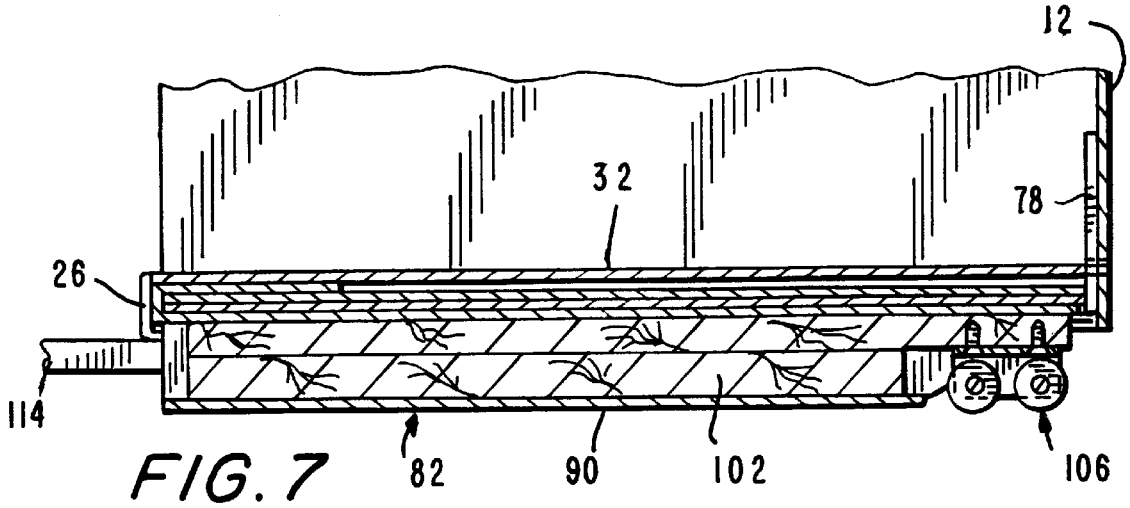
FIG. 7

SUPPORT PLATFORM FOR MOBILE DISPLAY STAND

BACKGROUND OF THE INVENTION

1. Field of the Invention

This invention generally relates to a foldable, erectable display stand for supportably displaying articles and, more particularly, to a support platform mountable on, and removable from, the stand for enabling the stand with the articles loaded thereon to be moved from one place to another, either with the aid of lifting equipment and/or by manually pushing and rolling the stand to a desired location.

2. Description of the Related Art

Foldable, erectable display stands for use, for example, in warehouse stores, supermarkets or other retail stores for display of articles or goods on sale are already known. See, for example, U.S. Pat. No. 4,493,424; U.S. Pat. No. 4,570,805; U.S. Pat. No. 4,646,922; U.S. Pat. No. 4,723,664 and No. RE-32,668.

Such stands are typically manufactured at one site, collapsed into a generally flattened condition in which they occupy a minimum amount of space individually and stacked on top of one another, and then are either shipped directly to a retail store, or to a packing center or warehouse, where the stands are erected in situ, and the articles are thereupon loaded onto the erected stands. Stands packed at the packing center are transported, typically by truck, to the retail store where the loaded stands are taken off the truck and moved to a desired location in the store.

Experience has shown that the conventional, foldable, erectable display stands are highly satisfactory for their intended purpose. However, when such stands are called upon to support substantial weight, e.g., beer cans, packaged hosiery, soda bottles, soap bars, etc., it has proven difficult to conveniently move the loaded stands from place to place. Thus, once a fully loaded stand is positioned in a retail store, it requires considerable effort to reposition the stand. Also, moving a fully loaded stand off a truck to a desired location in a store typically requires a forklift having a power-operated prong that can be raised and lowered for insertion underneath the display stand. To assist such lifting, it is known to position the display stand on a wooden pallet, or to glue a pair of skids on the bottom of a display stand to elevate the stand above the floor.

To enable easier movement of the loaded stand, the art has proposed the use of separate hand trucks and wheeled components of the type exemplified by U.S. Pat. No. 3,856,320; U.S. Pat. No. 4,461,504 and U.S. Pat. No. 4,632,412, as well as U.K. Patent No. 998,158 and International Publication No. WO 93/04880. However, such equipment was typically made of welded metal or molded of rigid plastic and was a relatively expensive permanent fixture which might not be readily available at the time the stand was to be moved.

The art also taught in U.S. Pat. No. 2,564,939; U.S. Pat. No. 3,087,740; U.S. Pat. No. 3,092,395; U.S. Pat. No. 3,135,527; U.S. Pat. No. 3,285,620; U.S. Pat. No. 3,292,942; U.S. Pat. No. 3,427,040; and U.S. Pat. No. 5,125,675, the use of shopping carts and trolleys, not erectable display stands made of cardboard material. However, even those units had a permanent construction in the sense that their wheels were permanently mounted on the carts and trolleys, and were meant to be re-used.

In the field of display stands made of corrugated board material, U.S. Pat. No. 5,443,168 and International Publication No. WO 94/19642 disclosed wheeled stands where a wheeled assembly was permanently built into the stand itself. The same was true for my earlier U.S. Pat. No. 5,628,523. Such built-in stands were, however, relatively expensive to fabricate, and the cost of such fabrication did not lend such stands to be discarded after its initial use.

My earlier U.S. Pat. No. 5,711,438 disclosed the convenient and rapid attachment and removal of a pre-assembled wheeled assembly on a foldable, erectable display stand. This stand has satisfied the market requirement for reducing the time, cost and handling required to move and re-position a loaded stand, without sacrificing the strength required by the stand to support articles of substantial weight. Even so, experience has shown that improvements can be offered to enable the loaded stand to be more easily moved, especially by a forklift, and to enable the loaded stand to be handled, even roughly, without the wheeled assembly becoming inadvertently dislodged from the stand and possibly becoming detached therefrom.

SUMMARY OF THE INVENTION

OBJECTS OF THE INVENTION

Accordingly, it is a general object of the present invention to advance the state of the art of display stands.

Another object of this invention is to provide a support platform that is quickly and easily attachable as a unit oh, and removable as a unit from, a display stand, without sacrificing the strength required by the stand to support articles of substantial weight and, at the same time, withstanding any tendency of the support platform from being dislodged from the stand due to rough handling during transport of the stand.

An additional object of this invention is to quickly and easily convert a foldable, erectable display stand that normally rests on a floor, to one that is easily movable, either by means of a forklift, and/or by manually pushing and rolling the stand across the floor.

Yet another object of this invention is to reduce the time, cost and handling normally required to move and re-position a loaded stand.

Another object of this invention is to devise a wheeled display stand which is simple in construction, inexpensive to manufacture, easy to use and reliable in operation.

FEATURES OF THE INVENTION

In keeping with these objects and others which will become apparent hereinafter, one feature of this invention resides, briefly stated, in a mobile display stand for supporting articles, especially merchandise of substantial weight. The stand includes a rear panel extending along a longitudinal direction. A first, generally planar, base panel is hingedly connected to the rear panel. A second, generally planar, base panel is hingedly connected to, and overlaps, the first base panel to bound a space with the first base panel. A shelf is elevated relative to the base panels and extends away from the rear panel for supporting the articles to be displayed.

In accordance with this invention, a pre-assembled support platform is attachable as a unit on, and is removable as a unit from, the stand. The support platform includes a generally planar, support panel which is located in the space and which is sandwiched by and between the base panels, and a pair of side lifts which are located exteriorly of the space and are mounted on the support panel in a spaced-apart relationship as considered along a transverse direction generally perpendicular to the longitudinal direction. The side lifts extend along the longitudinal direction away from the shelf and the base panels for supporting the base panels above a floor.

The elevated support panel which is incorporated into the stand enables the power-operated prong of a forklift to easily enter the region between the side lifts and to be raised and lowered, as required, to engage the stand from underneath the stand. No longer is it necessary for the stand to be mounted atop a wooden pallet, or to have a pair of skids glued permanently to the underside of the stand as is known in the art. Without the support platform, the stand simply rests on the floor. However, the convenient and rapid attachment and incorporation of the support platform into the stand enables the built-in pallet to work more easily with forklifts.

This incorporation is achieved, in accordance with one preferred embodiment of this invention, by enabling the base panels to be folded from an unfolded position in which access is granted to the space, to a folded position in which the base panels are in generally mutual parallelism. The support panel is in surface area engagement with the base panels, thereby insuring a secure mounting.

A locking structure is provided for maintaining the second base panel in the folded position. The second base panel has a pair of locking tabs, and the rear panel has a pair of slots for lockingly receiving the locking tabs in the folded position. This insures that the support panel will not shift from its position between the base panels.

The stand further includes a pair of generally planar side panels spaced apart from each other along the transverse direction and hingedly connected to the rear panel. The side panels have side flaps that are received in the space and are sandwiched by and between the base panels. Thus, the side panels are held in a predetermined position, for further strengthening the overall rigidity of the stand.

According to the preferred embodiment, each side lift extends along a depthwise direction extending generally perpendicular to the longitudinal and transverse directions. Each side lift includes a generally planar, bottom wall for engaging the floor, and a pair of riser walls connected to the bottom wall and extending along the longitudinal direction. The walls of each side lift extend along the depthwise direction and bound an elongated channel below the support panel. Preferably, a rigid elongated insert, e.g., a wooden plank, is located within a respective channel to support the walls of each side lift from collapse.

Another important feature of this invention is embodied in journaling a pair of side wheel assemblies exteriorly of the space on the support platform for enabling the stand to be manually pushed and rolled from one place to another. Preferably, each side wheel assembly is mounted on a respective insert, and each side wheel assembly includes a pair of rollers mounted on a bracket. The bracket is secured to the respective insert.

The attachment and removal of the wheeled support platform as a pre-assembled unit provides many benefits. Thus, the stand may be shipped in a collapsed condition to the packing center, thereby minimizing shipping costs and cargo space. The wheeled support platform is not mounted on the stand when it is in the collapsed condition, but is separately shipped. Only when it is desired to pack articles on the stand is the wheeled support platform attached to the erected stand, thereby ensuring easy movement and positioning thereof either by a forklift, or by manually pushing and rolling the stand from place to place, or by both means. After the articles have been sold and removed from the stand, the wheeled support platform can be easily removed from the stand and re-used, if desired, on another stand. The original stand, constituted substantially entirely of corrugated board material, can be folded up and sent to a paper recycling center.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 is a sectional view on an enlarged scale and taken on line 6—6 of FIG. 3; and FIG. 7 is a sectional view on an enlarged scale and taken on line 7—7 of FIG. 3.

DETAILED DESCRIPTION OF THE PREFERRED EMBODIMENT

Figure 1:
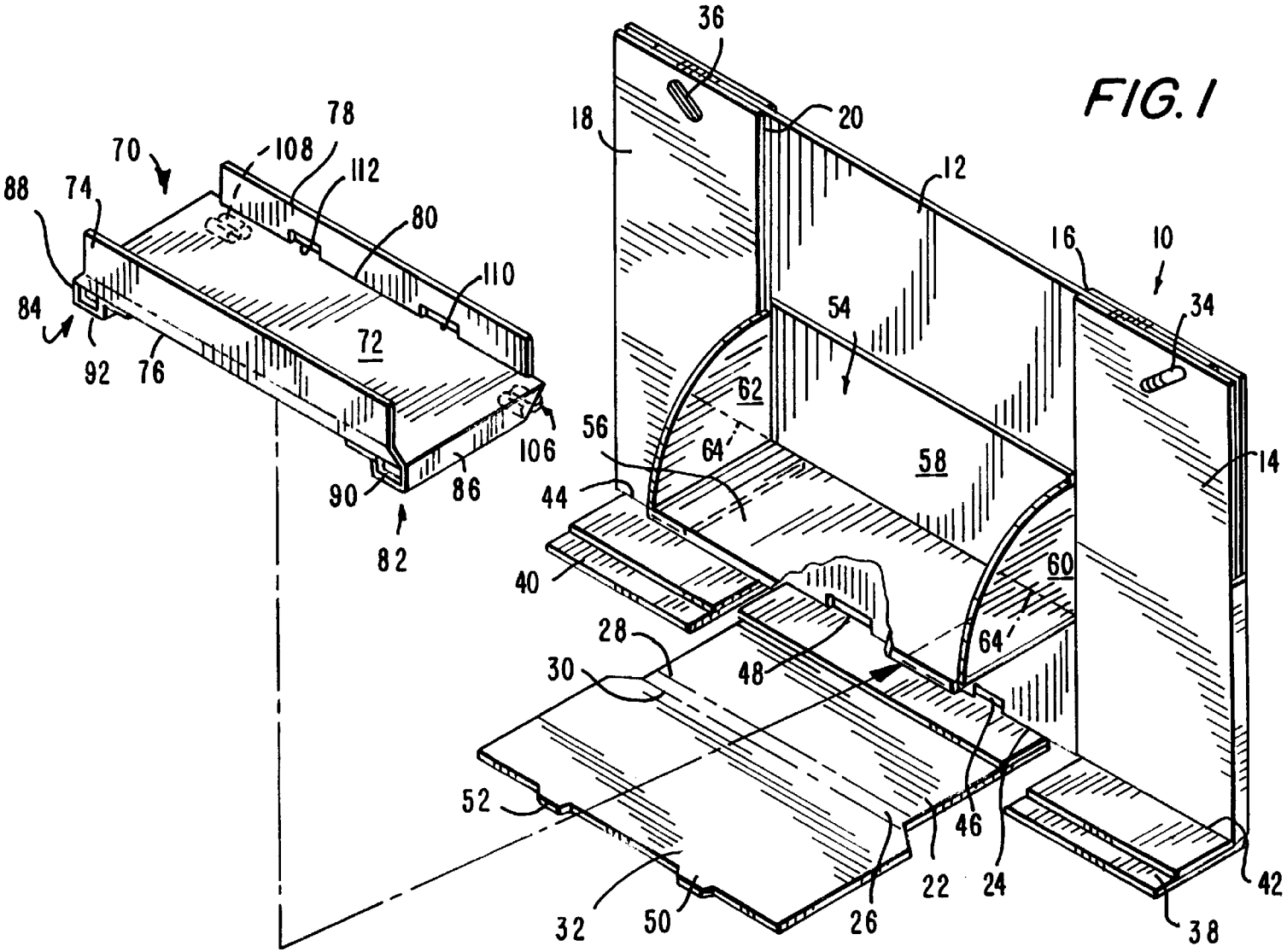
FIG. 1 is a front perspective, exploded view of a foldable, erectable display stand during an initial stage of assembly with a mobile support platform in accordance with this in invention.

Referring now to the drawings, reference numeral 10 in FIG. 1 generally identifies a foldable, display stand having a generally planar, upright, rear panel 12, a generally planar, first side panel 14 hinged to the rear panel 12 and foldable about vertical fold line 16, a generally planar, second side panel 18 hinged to the rear panel 12 and foldable about vertical fold line 20, a generally planar, first base panel 22 hinged to the rear panel 12 and foldable about horizontal fold line 24, a generally planar, spacer panel 26 hinged to the first base panel 22 and foldable about horizontal fold line 28, and a generally planar, second base panel 32 hinged to the spacer panel 26 and foldable about horizontal fold line 30. Vertical fold lines 16, 20 are parallel to each other. Horizontal fold lines 24, 28, 30 are parallel to one another.

Side panels 14, 18 have upper slots 34, 36 that serve as handholds as explained below in connection with FIG. 4. Side panels 14, 18 also have lower, bottom flaps 38, 40 that are hinged to the side panels 14, 18 and foldable about horizontal fold lines 42, 44, respectively. Fold lines 42, 24, 44 are co-linear.

Rear panel 12 has a pair of slots 46, 48 situated adjacent the fold line 24. Second base panel 32 has a pair of projections or tabs 50, 52 that are dimensioned to be received in slots 46, 48 with a locking action when base panel 32 is folded into an overlapping relationship with first base panel 22, as described below.

As described so far, all the panels are constituted of a single piece of sheet material, preferably of corrugated board. The panels initially lie in a common plane and are erected by folding the panels about their respective fold lines into a three-dimensional configuration. Thus, as shown in FIG. 1, the rear panel 12, the first side panel 14 and the second side panel 18 are folded about fold lines 24, 42, 44 respectively so that the panels 12, 14, 18 generally lie in a vertical plane, and the base panel 22 and the bottom flaps 38, 40 generally lie in a horizontal plane. Side panels 14, 18 are folded about fold lines 16, 20 until the side panels 14, 18 lie in mutually parallel planes perpendicular to the rear panel, and the bottom flaps 38, 40 are situated on top of the base panel 22.

Thereupon, the second base panel 32 is folded about fold line 30. This movement causes the spacer panel 26 to fold about fold line 28 and lie in a vertical plane generally parallel to the rear panel 12. The tabs 50, 52 are inserted into the slots 46, 48, thereby locking the second base panel 32 into an overlapping, vertically spaced relationship with the first base panel 22. The vertical spacing between the base panels 22, 32 is sufficient to snugly accommodate the bottom flaps 38, 40 between the base panels 22, 32 and to hold the side panels 14, 18 in mutual parallelism.

A shelf 54 is mounted on the rear panel 12 at an elevation above the base panels 22, 32. A plurality of shelves, one vertically stacked above another, along the vertical direction lengthwise of the rear panel, is contemplated for the preferred embodiment. Only one shelf has been illustrated in order to simplify the drawing. Each shelf 54 has a load-bearing horizontal portion 56 on which articles to be displayed are supported, a vertical portion 58 for attachment to the rear panel 12, typically by an adhesive or staples, and a pair of sector-shaped arm portions 60, 62 that support opposite ends of the horizontal portion 56. The arm portions 60, 62 preferably have radial crease lines 64 to permit the horizontal portion to be initially folded flat up against the vertical portion 58 during shipment of the stand in a collapsed condition to conserve cargo space. Rather than placing the articles to be displayed directly on the load-bearing horizontal portion 56, the articles, in the preferred embodiment are pre-packed in a tray or carton. Thereupon, the loaded carton is placed on the horizontal portion 56.

As described so far, the erected display stand 10 rests on the floor with the base panel 22 directly engaging the floor. With the shelves laden with articles, especially of substantial weight, it is difficult to move the stand, either by hand, or even by forklift since the power-operated prong cannot fit between the base panel 22 and the floor at least not without tilting the stand and possibly spilling the articles therefrom.

In accordance with this invention, a pre-assembled mobile support platform 70 is attachable as a unit on, and removable as a unit from, the stand. The platform 70 includes a generally planar, support panel 72, a front flap 74 hinged to a front edge of the support panel 72 and foldable about a horizontal fold line 76, and a rear flap 78 hinged to a rear edge of the support panel 72 and foldable about a horizontal fold line 80.

The platform 70 further includes a pair of elongated side lifts 82, 84 integral with the support panel and extending between the front and rear edges of the support panel. Side lifts 82, 84 include first, vertical riser walls 86, 88 hinged to opposite side edges of the support panel 72; generally planar, base walls 90, 92 hinged to the first riser walls 86, 88; second, vertical riser walls 94, 96 hinged to the base walls 90, 92; and connector walls 98, 100 hinged to the second riser walls and secured, for example, by glueing or stapling, to the support panel.

When the connector walls 98, 100 are so connected, the riser walls 86, 94 of the first side lift 82 lie in vertical planes, and the base wall 90 lies in a horizontal plane. Also, the riser walls 88, 96 of the second side lift 84 lie in vertical planes, and the base wall 92 lies in a horizontal plane. The walls 86, 90, 94 bound a first channel, preferably of square cross-section, and the walls 88, 92, 96 bound a second channel, also preferably of square cross-section.

Since, as described below, the display stand will eventually rest on the base walls 90, 92, it is desired to prevent the riser walls from buckling and, to that end, the channels are not left vacant, but instead, are filled with elongated inserts 102, 104 that extend lengthwise of the side lifts. The inserts 102, 104 are constituted of any material and, in the preferred embodiment, the inserts are one or more planks of wood. In other embodiments, a honeycomb structure of corrugated board serves as the material for the inserts.

At the rear regions of the side lifts 82, 84, the base walls 90, 92 are cut away and, optionally, parts of the riser walls are cut away, thereby exposing the ends of the inserts 102, 104 that are located at these rear regions. A pair of side wheel assemblies 106, 108 is located at, and mounted on, the exposed ends of the inserts. Each wheel assembly preferably includes a pair of low friction, plastic rollers mounted in a side-by-side relationship on parallel axes on a metal bracket which, in turn, is secured to one of the wooden planks whose end is exposed. The outer surface of the rollers is generally in the same plane as that of the base walls 90, 92.

The platform 70 still further includes a pair of apertures 110, 112 adjacent fold line 80 and extending through the rear flap 78. The apertures 110, 112 are spaced transversely apart the same distance as the slots 46, 48 and as the tabs 50, 52 are spaced apart.

In order to convert the display stand 10 which rests directly on the floor to a mobile stand that is capable of being easily transported, the second base panel 32 is folded outwardly to its position illustrated in FIG. 1, and thereupon the support panel 72 of the platform 70 is placed on top of the exposed first base panel 22. The rear flap 78 bears directly against the rear panel 12. The apertures 110, 112 are aligned with the slots 46, 48.

Figure 2:
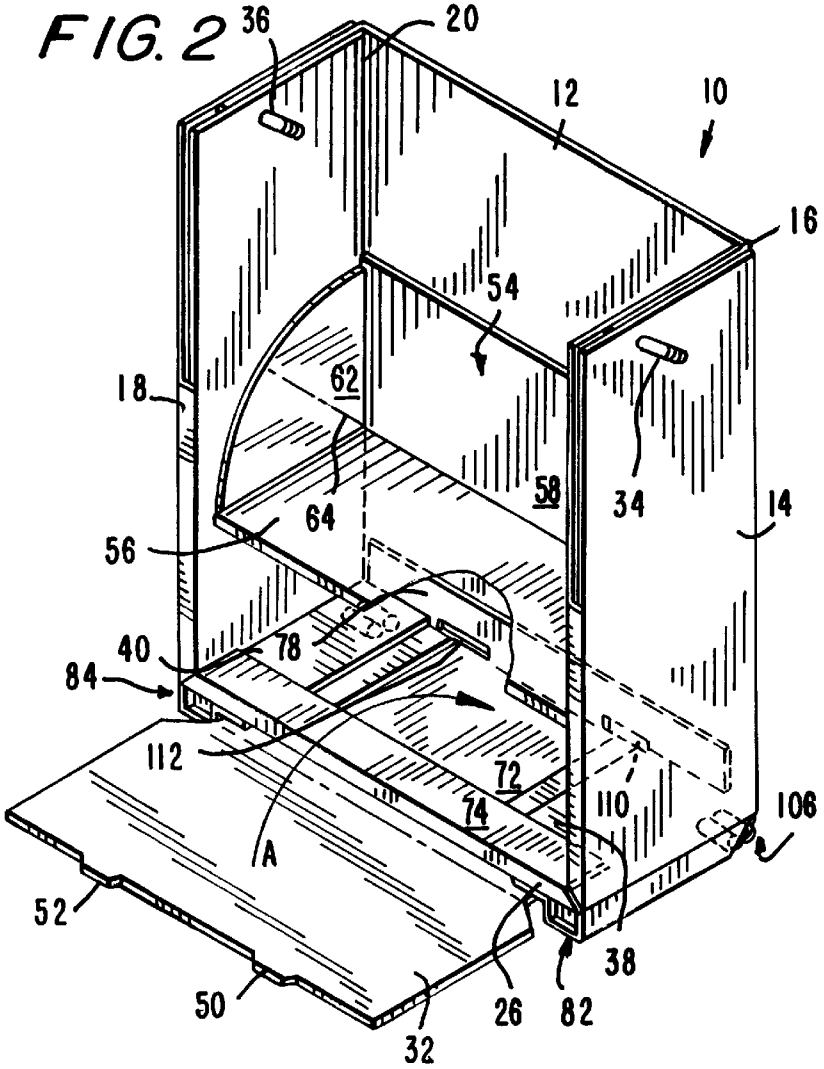
FIG. 2 is a view analogous to FIG. 1 at a subsequent stage of assembly.

Next, the side panels 14, 18 are folded into mutual parallelism as described above. The bottom flaps 38, 40, rather than directly engaging the first base panel 22 as described above, now lie on top of, and engage, the support panel 72. As shown in FIG. 2, the front flap 74 is now folded flat on top of the bottom flaps 38, 40, thereby holding the bottom flaps in place. The second base panel 32 is folded in the direction of arrow A on top of the front flap 74 and into an overlapping relationship with the first base panel 22. The tabs 50, 52 are inserted through the aligned apertures 110, 112 and slots 46, 48, thereby locking the support platform in place.

In the locked condition, the support panel 72 is sandwiched by and between the base panels 22, 32, and is securely friction-tightly held in the space therebetween. The side lifts 82, 84 and the side wheel assemblies 106, 108 straddle the first base panel 22 and are located outside said space. The side lifts and the wheel assemblies extend downwardly beyond the base panel 22 and elevate the latter above the floor.

Figure 3:
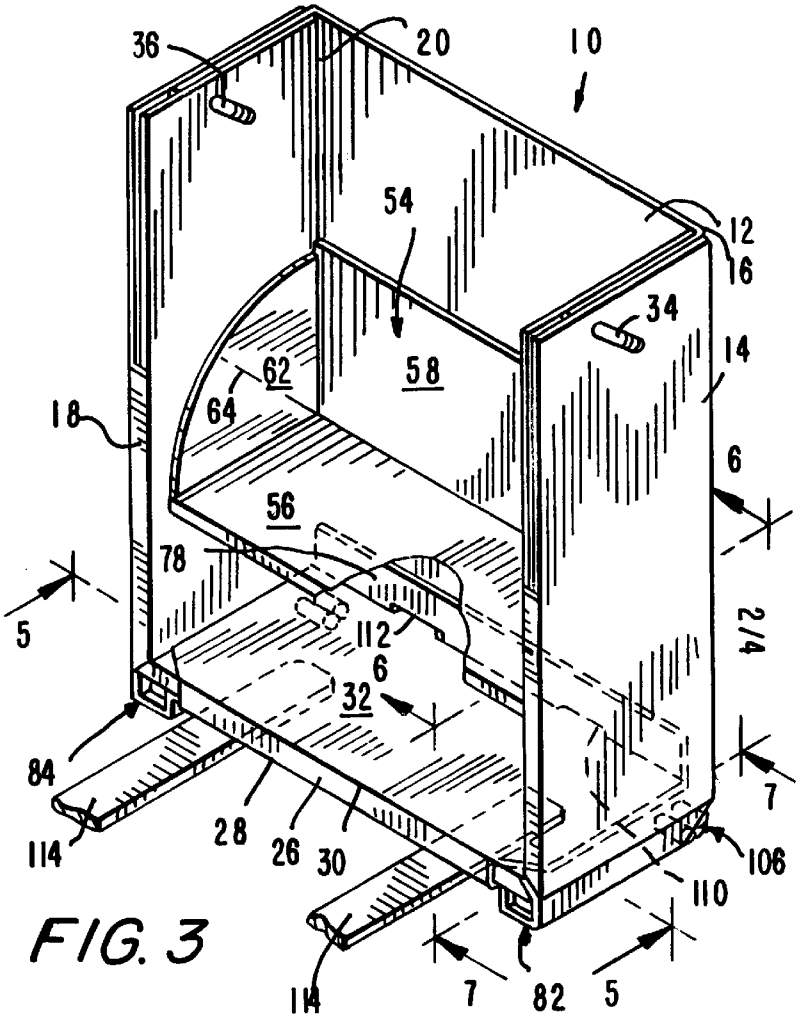
FIG. 3 is a view analogous to FIG. 2 but at a final stage of assembly, the assembled mobile display stand being shown with a broken-away perspective view of a power-operated prong of a forklift.

FIG. 3 depicts the mobile stand 110 with the platform in place and resting on the base walls 90, 92. The region between the side lifts is readily accessible to a power-operated prong 114 (shown in broken-away view) of a conventional forklift for raising, lowering and moving the stand as required. This contrasts to the prior art where, as noted above, a display stand sits directly on top of a pallet, or where a pair of skids are permanently glued to the underside of a stand.

Figure 4:
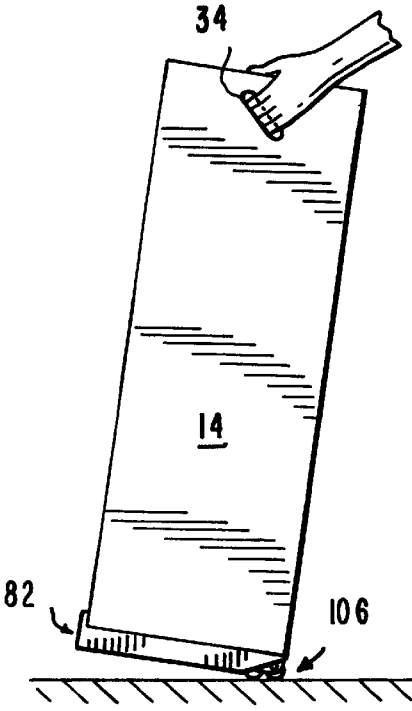
FIG. 4 is a side elevational view of the mobile display stand during rolling across a floor.
Figure 5:
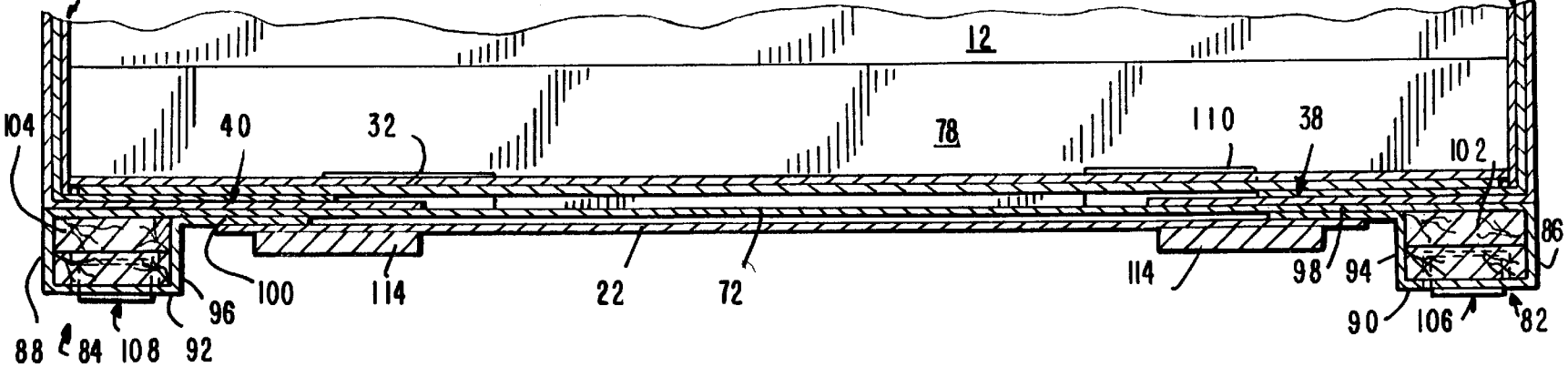
FIG. 5 is a sectional view on an enlarged scale and taken on line 5—5 of FIG. 3.

FIG. 4 depicts the mobile stand 110 when it is desired to manually move the latter. A person grasps the handholds 34, 36, tilts the stand, and rolls the stand on the wheel assemblies to a desired location.

The support platform 70 allows for a quick and easy conversion of a display stand from a stand-alone condition in which the stand rests directly on the floor, to a mobile condition in which the stand permits movement by manual means, or by powered equipment. Removal of the platform 70 simply involves unfolding the base panel 32 to its position illustrated in FIG. 1, and picking up the platform.

It will be understood that each of the elements described above, or two or more together, also may find a useful application in other types of constructions differing from the types described above.

While the invention has been illustrated and described as embodied in a support platform for a mobile display stand, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims:

I claim:

1. A mobile display stand for supporting articles, comprising:

a) a rear panel extending along a longitudinal direction;

b) a first, generally planar, base panel hingedly connected to the rear panel;

c) a second, generally planar, base panel hingedly connected to, and overlapping, the first base panel to bound a space with the first base panel;

d) a shelf elevated relative to the base panels and extending away from the rear panel for supporting the articles to be displayed; and e) a pre-assembled support platform attachable as a unit on, and removable as a unit from, the stand, the support platform including a generally planar, support panel located in the space and sandwiched by and between the base panels, and a pair of side lifts located exteriorly of the space and mounted on the support panel in a spaced-apart relationship as considered along a transverse direction generally perpendicular to the longitudinal direction, the side lifts extending along the longitudinal direction away from the shelf and the base panels for supporting the base panels above a floor.

2. The stand according to claim 1, wherein the second base panel is movable relative to the first base panel from an unfolded position in which access is granted to the space, to a folded position in which the base panels are in generally mutual parallelism.

3. The stand according to claim 2, wherein the second base panel includes a locking structure for fixing the second base panel in the folded position.

4. The stand according to claim 3, wherein the locking structure includes a pair of locking tabs, and wherein the rear panel has a pair of slots for lockingly receiving the locking tabs in the folded position.

5. The stand according to claim 1; and further comprising a pair of generally planar, side panels spaced apart from each other along the transverse direction and hingedly connected to the rear panel, the side panels having side flaps that are received in the space and are sandwiched by and between the base panels.

6. The stand according to claim 5, wherein the shelf includes a pair of side arms connected to the rear panel, and wherein the side arms lie adjacent the side panels.

7. The stand according to claim 1, wherein each side lift extends along a depthwise direction extending generally perpendicular to the longitudinal and transverse directions.

8. The stand according to claim 7, wherein each side lift includes a generally planar, bottom wall for engaging the floor, and a pair of riser walls connected to the bottom wall and extending along the longitudinal direction, and wherein the walls of each side lift extend along the depthwise direction and bound an elongated channel below the support panel.

9. The stand according to claim 8, wherein the support platform includes a rigid elongated insert located within a respective channel to support the walls of each side lift from collapse.

10. The stand according to claim 9, wherein the support platform includes a pair of side wheel assemblies located exteriorly of the space and journaled on the support platform adjacent the side lifts in a spaced-apart relationship along the transverse direction for rolling the stand from one place to another.

11. The stand according to claim 10, wherein each side wheel assembly is mounted on a respective insert.

12. The stand according to claim 11, wherein each side wheel assembly includes a pair of rollers mounted on a bracket, and wherein the bracket is secured to the respective insert.

13. A pre-assembled support platform for enabling a display stand to be moved, the platform comprising:

a) a generally planar support panel having upper and lower surfaces;

b) a pair of elongated side lifts at the lower surface of the support panel, each side lift extending along a depthwise direction, the side lifts being spaced apart along a transverse direction generally perpendicular to the depthwise direction, each side lift having a generally planar, bottom wall generally parallel to the support panel, each side lift further having a pair of riser walls extending vertically along a longitudinal direction generally perpendicular to the depthwise and transverse directions, the riser walls of the side lifts bounding with the lower surface of the support panel an open passage extending along the depthwise direction entirely underneath the support panel; and c) a pair of side wheel assemblies journaled on the platform in respective alignment with the side lifts, and spaced apart of each other along the transverse direction, the side wheel assemblies being located remote from the open passage.

14. The platform according to claim 13, wherein the walls of each side lift extend along the depthwise direction and bound an elongated channel below the support panel.

15. The platform according to claim 14, and further comprising a rigid elongated insert located within a respective channel to support the walls of each side lift from collapse.

16. The platform according to claim 15, wherein each side wheel assembly is mounted on a respective insert.

17. The platform according to claim 16, wherein each side wheel assembly includes a pair of rollers mounted on a bracket, and wherein the bracket is secured to the respective insert.

18. The platform according to claim 13, wherein the support panel is constituted of a corrugated board sheet material.

19. A mobile display stand for supporting articles, comprising:

a) a rear panel extending along a longitudinal direction;

b) a first, generally planar, base panel hingedly connected to the rear panel;

c) a second, generally planar, base panel hingedly connected to, and overlapping, the first base panel to bound a space with the first base panel;

d) a shelf elevated relative to the base panels and extending away from the rear panel for supporting the articles to be displayed; and e) a pre-assembled support platform attachable as a unit on, and removable as a unit from, the stand, the support platform including a generally planar, support panel located in the space and sandwiched by and between the base panels, and a pair of side lifts located exteriorly of the space and mounted on the support panel in a spaced-apart relationship as considered along a transverse direction generally perpendicular to the longitudinal direction, the side lifts extending along the longitudinal direction away from the shelf and the base panels for supporting the base panels above a floor, the support platform including a pair of side wheel assemblies located exteriorly of the space and journaled on the support platform adjacent the side lifts in a spaced-apart relationship along the transverse direction for rolling the stand from one place to another.

* * * * *